United States Patent [19]

James et al.

[11] Patent Number: 4,832,070

[45] Date of Patent: May 23, 1989

[54] FLAME FAILURE DEVICES

[75] Inventors: Robert James, Solihull; Peter D. Roberts, Tamworth, both of England

[73] Assignee: Concentric Controls Limited, Birmingham, England

[21] Appl. No.: 151,840

[22] Filed: Feb. 3, 1988

[30] Foreign Application Priority Data

| | | | |
|---|---|---|---|
| Feb. 7, 1987 | [GB] | United Kingdom | 8702797 |
| Apr. 11, 1987 | [GB] | United Kingdom | 8708722 |
| Nov. 27, 1987 | [GB] | United Kingdom | 8727829 |

[51] Int. Cl.[4] ..... F23D 5/16; F16K 31/64

[52] U.S. Cl. ..... 137/65; 126/52; 236/99 R; 251/65; 431/59

[58] Field of Search ..... 126/52, 374; 137/65; 251/65; 431/59, 75, 77, 85; 236/99 R

[56] References Cited

U.S. PATENT DOCUMENTS

| | | | |
|---|---|---|---|
| 1,720,900 | 7/1929 | Ileman | 431/85 |
| 2,417,577 | 3/1947 | Van Denberg et al. | 137/65 |
| 2,683,486 | 7/1954 | Wittmann | 431/59 |
| 2,688,364 | 9/1954 | Wittmann | 431/59 |
| 2,716,015 | 8/1955 | Allen | 137/65 |
| 2,746,471 | 5/1956 | Cobb | 137/65 |
| 2,752,930 | 7/1956 | Stouder | 251/297 |
| 3,975,135 | 8/1976 | Kinsella et al. | 137/65 |
| 4,303,384 | 12/1981 | Barnes | 137/65 |
| 4,518,003 | 5/1985 | Charron | 236/99 R |

*Primary Examiner*—George L. Walton
*Attorney, Agent, or Firm*—Learman & McCulloch

[57] ABSTRACT

The invention provides a flame failure device in which the reservoir exposed to the flame is charged with air and is communicated via a capillary tube to displace a membrane and hold the main valve in an open position, and the valve is closed by a spring when pressure falls as a result of the flame being extinguished. The system is re-charged via a one-way valve when pressure in the system falls below ambient pressure.

7 Claims, 3 Drawing Sheets

FLAME FAILURE DEVICES

This invention relates to flame failure devices for gas supply control valves. Briefly, these are to cut off the supply of gas when the flame fails. The usual construction has a mercury filled reservoir exposed to the flame and the pressure of the mercury vapour actuates the control valve directly or indirectly, e.g. via a servo.

Mercury is expensive and creates problems in manufacture because of its toxicity. It is well understood that a replacement for the mercury would be highly desirable. However, the operating conditions are arduous, with the reservoir exposed to the high temperature of the flame and subject to temperature cycling when the flame is extinguished and relit. In practice this has meant that possible materials for use in the reservoir as substitutes for the mercury have been found to be unsatisfactory. They are unstable when subject to repeated temperature cycling over the temperature ranges involved, or react with the other materials used for example for the reservoir or control valve.

The object of the invention is to solve this problem, avoid the use of mercury, and provide a satisfactory flame failure device.

According to the invention, a flame failure device comprises a reservoir located to be heated by a flame and connected to a valve effective in the supply of fuel to feed said flame, and characterised in that the reservoir is charged with an atmospheric gas. Preferably the gas is air.

According to an important feature of the invention, the system comprising the reservoir has a one-way valve which is arranged to be closed when the pressure is high and open when the pressure low, to allow recharging of the system.

When the system is charged with air, the reservoir will be filled at atmospheric pressure at the time of manufacture. The pressure will rise rapidly when the reservoir is exposed to flame, and fall back to the same level when cold. The reservoir will thus be at the same internal pressure as the ambient atmosphere (ignoring barometric variations) when there is no flame and the reservoir has cooled to ambient temperature. By using air as the working fluid, the one-way or non-return valve may communicate between the ambient atmosphere and the reservoir interior, and be arranged to open when the reservoir is at less than ambient pressure, and close when at more than ambient pressure. Hence the reservoir is self-recharging.

The invention is more particularly described with reference to the accompanying drawings in which.

Figure 1:
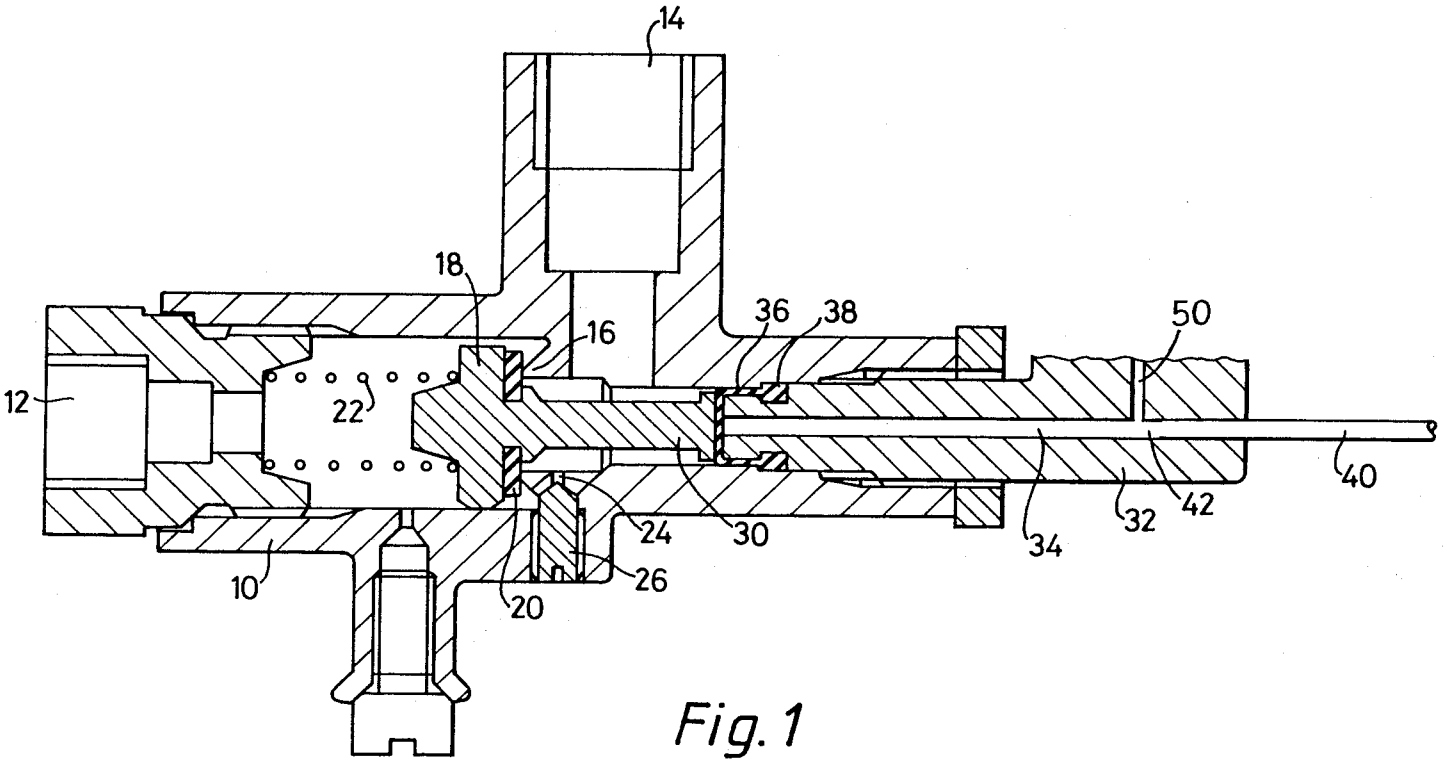
FIG. 1 is a sectional elevation showing the gas control valve part of a system according to the invention.

Turning first to FIG. 1, the control valve shown therein comprises a body 10 having an inlet 12 and an outlet 14 separated by a valve seat 16. The closure element or plug 18 carries a resilient sealing washer 20 and is urged onto the seat by spring 22. A by-pass 24 is controlled by a screw 26 to allow a limited bleed flow past the seat when the closure is in sealing relation, for example to maintain a pilot flame.

The valve plug 18 has an integral stem 30 terminating in a head for displacement by the flame failure system to hold the plug in the open position allowing main flow from the inlet to the outlet.

An end fitting 32 is secured to the valve body and has a bore 34 extending through its length. The inner end of the fitting 32 is provided with a displaceable imperforate rubber or like membrane 36 held to the fitting by an integral bead 38 engaged in a peripheral groove in the fitting, and the membrane extends across the end of the bore 34.

The opposite end of the bore 34 is connected to a capillary tube 40 which in turn is connected to a reservoir bulb arranged to be exposed to the flame which is to be detected. The interior of the bulb, the capillary tube and the bore 34 are all charged with air at atmospheric pressure at ambient temperature.

A branch passage 42 connects the bore 34 to a valve block which will be further described hereinafter.

In operation of the arrangement in FIG. 1, flame acting upon the bulb (not shown) raises the pressure of the air in the system and this deflects the membrane 36 to the left in the figure thus displacing the valve plug 30 and lifting the resilient washer 20 off the seat 16 to allow main gas flow through the valve from the inlet to the outlet. When the flame is extinguished, the air in the reservoir cools and the spring 22 returns the valve to close the main flow path.

The arrangement shown in FIG. 1 may be considered as a direct acting valve in which the reservoir generated pressure acts directly upon the main gas control valve element 30. However, the invention can also be employed to operate a servo-valve or mechanism which in turn operates the (main) gas valve, as shown for example in FIG. 2.

Figure 2:
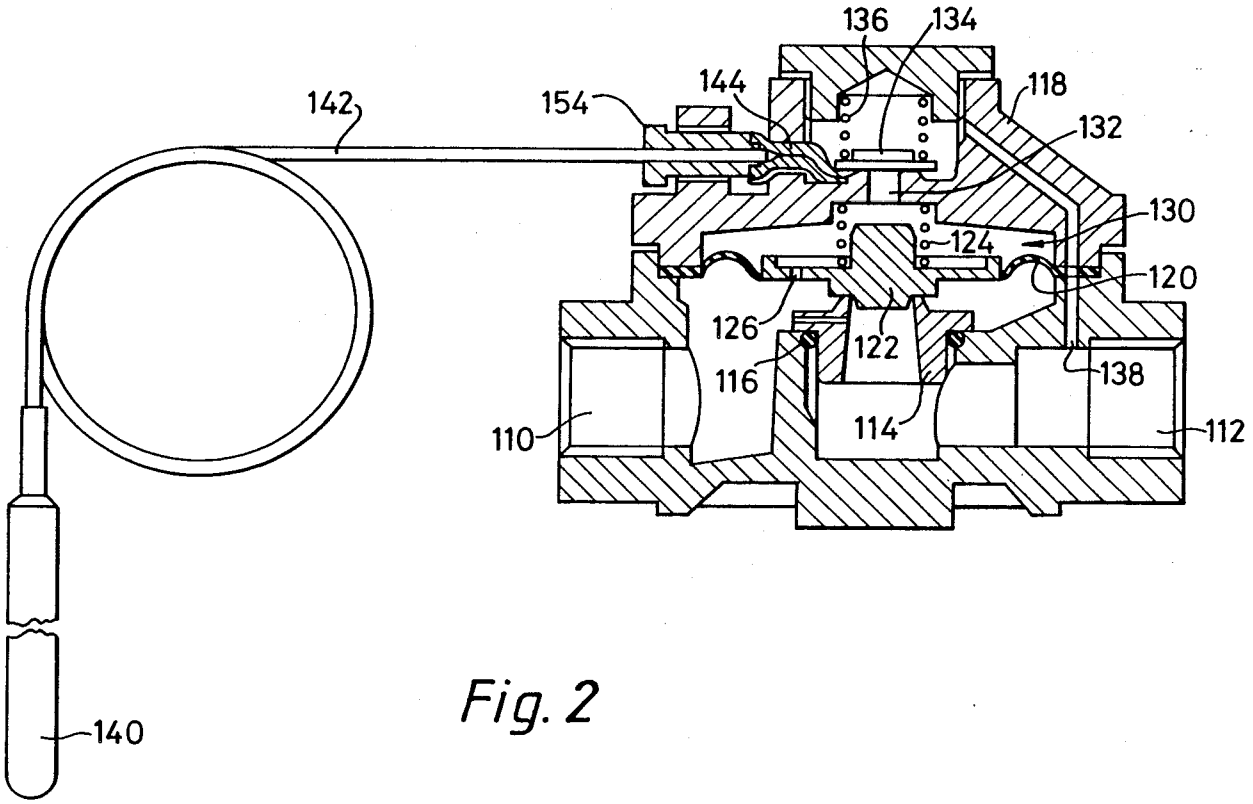
FIG. 2 is a view of an alternative arrangement.

Turning now to FIG. 2, the valve body provides an inlet 110 and an outlet 112 extending by way of a web provided with a seat formed on one end of an annular plug 114 secured in the web for an example with an O ring 116 to provide a gas tight connection between the plug and web.

The body is completed by cap 118 and a diaphragm 120 is clamped at its outer periphery, between the cap and body. The diaphragm carries a valve closure member 122 for movement towards and away from the seat.

A helical compression spring (for example) 124 is trapped between the diaphragm and the cap and urges the closure onto the seat.

A bleed passage 126 extends through the diaphragm so as to communicate gas pressure from the inlet into a chamber 130 defined between the diaphragm and the cap. The chamber has an exhaust port 132 closed by a valve member 134 held in place by a (for example) helical compression spring 136. A return path 138 opens from the opposite side of the valve 134 to the port 132, extending to the outlet port 112.

A further bleed passage (not shown) extends from the inlet side 110 to the outlet side 112 below the diaphragm, to allow a pilot light to remain lit.

The arrangement as thus far described is one in which the gas pressure in the chamber 130 will be the same as that in the inlet 110, when both valve members are closed. They are respectively held on their seats by their springs. When valve member 134 is opened, gas in the chamber 130 flows through the exhaust port 132 and via the return path 138 to the outlet 112 and the balancing pressure on the diaphragm is thus relieved so that the gas inlet pressure can overcome the spring 124 to open the (main) valve 122 and allow full gas flow direct from inlet to outlet.

The valve 134 which controls the exhaust path is arranged to be lifted against the spring 136 by pressure derived from bulb 140 via capillary 142 and actuator 144.

The bulb 140 and capillary are of conventional construction except that instead of being charged with mercury they are simply charged with atmospheric air.

The actuator 144 may be an imperforate hollow, toroidal membrane of elastomeric material connected to the capillary so that as the pressure rises in the bulb 140 the actuator is inflated and this lifts the valve 134 off its seat to allow flow from exhaust port 132 to path 138.

To simplify the construction of the valve 134, the actuator may be made from two discs of elastomeric material secured, for example welded together, around their periphery and also generally radially so as to leave a somewhat horseshoe shape where the discs are not secured together, and with the interior of that horseshoe connected to the capillary tube in conventional manner. Hence, inflation as a result of increased pressure in the bulb 140 will lift the valve 134, which is normally seated upon that actuator, but allow flow generally radially of the activator along the radius coincident with the line of the welding or other securement of the two discs one to the other where the inflated disc thickness is not increased. Such an arrangement may enable a simple disc valve to be used for the part 134 and the actuator, being of an elastomeric material forms a yielding and gas tight valve seat at times when it is not inflated.

However other constructions are possible for the actuator and valve. For example the valve 134 can be arranged to hinge about a point at one edge when the actuator is inflated between the opposite edge and valve seat, and in that case the capillary may be co-axial with a simple tubular actuator.

It will be appreciated by those skilled in the art that the bleed passage 126 is essentially smaller in cross-sectional area than the flow path from the chamber 130 to the outlet port 112 at all points so that gas can escape from that chamber faster than it can flow into the chamber: and the extent of difference may be a factor in the speed of operation of the valve.

It will also be appreciated by those skilled in the art that the spring pressures are to be selected with care so as to give the desired operating characteristics. At least the spring 136 has to be selected according to the operating characteristics of the bulb and capillary.

The system as described above may be subject to loss of air due to inevitable slight porosity of the elastomeric material, or manufacturing tolerances for example: such loss is likely to occur in the high pressure portion of the operating cycle and possibly only above certain pressures or temperatures such as may be due to leakage paths opening up after expansion following temperature rise. If such incremental accumulating losses (from successive cycles) are not replaced, the system must eventually fail because the remaining air content will be insufficient to reach the needful operating pressure at the elevated temperature.

Whilst good design may provide ample tolerances, the invention avoids any possibility of difficulty from such leakage by the provision of a non-return valve.

Figure 3:
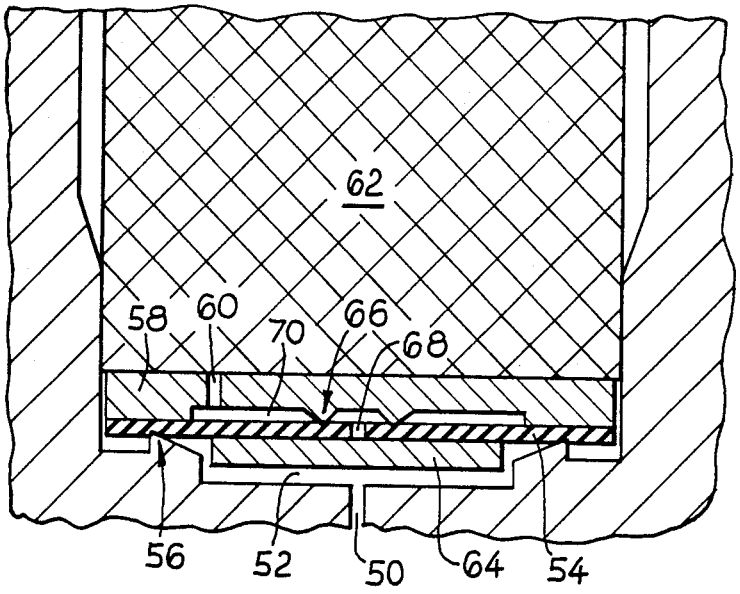
FIGS. 3 and 4 are enlarged fragmentary sectional views showing components for use for example in the FIG. 1 arrangement.

FIG. 3 shows one possible arrangement of non-return valve primarily intended for use in the FIG. 1 arrangement, although capable of use in similar fashion in the FIG. 2 arrangement.

The capillary tube 40 (or effectively the passage 34 which is a continuation of the tube bore) is connected to a branch bore 50 (FIG. 1). Referring now to Figure 3, branch bore 50 communicates with a chamber 52 which is effectively closed by a yielding resilient for example sheet rubber diaphragm 54 which is sealed near to its periphery by compression between an annular rib 56 surrounding the chamber 52 and a pressure plate 58.

The pressure plate is ported through its thickness at 60 and is held in position by a porous air filter block 62 which in this instance is a magnet made from powdered materials by a sintering process so as to give controlled porosity.

The pressure plate 58 is non-magnetic, for example brass, but on the opposite side of the diaphragm, that is loose within the chamber 52 is an iron disk 64 which is attracted by the magnetic flux towards the magnet. The pressure plate 58 is also provided with a small annular rib 66 which contacts the diaphragm around a central port 68 opening through the thickness of the diaphragm. The pressure plate is relieved over an area surrounding the annular rib 66 and including the port 60 so as to form a second chamber 70.

When the pressure in the passage 34 and hence in the passage 50 and chamber 52 is the same as or more than the pressure in chamber 70, the plate 64 is attracted by the magnet and holds the diaphragm against the annular rib 66 so as to seal the chamber 52 and maintain the pressure in the system. When the pressure falls, for example as a result of leakage, pressure in the chamber 70 may exceed that in the chamber 52 sufficiently to overcome the magnetic flux and allow the diaphragm to deflect towards the port and thus allow flow from the port 60 through the branch 50 into the system. It is be appreciated that the porous magnet allows continuous diffusion of air through it to replenish the chamber.

It will be noted that only a small magnetic flux is required to hold the plate 64 in the position because the high pressure in the system (at times when the flame is lit) will act to complete the seal.

Figure 4:
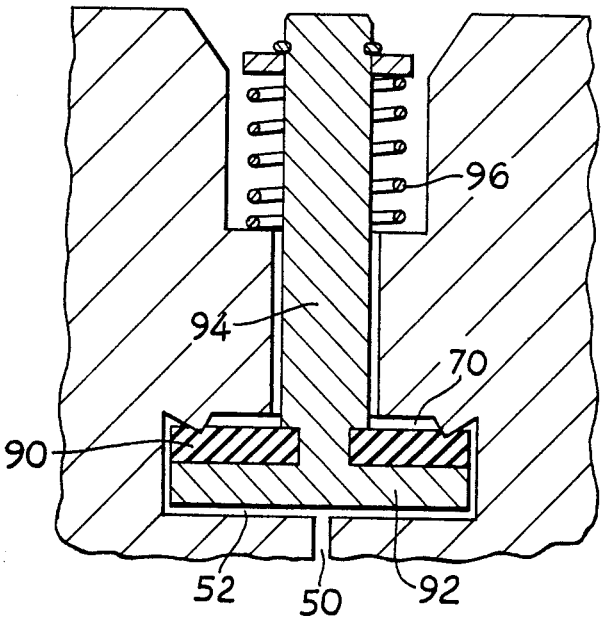

The arrangement in FIG. 4 is capable of use as an alternative one way valve, and this employs a spring instead of a magnet and keeper. In this instance, branch 50 opens into chamber 52 which is sealed from chamber 70 at ambient atmosphere by means of the resilient sealing annulus 90 carried on the head 92 attached to stem 94 and urged into sealing position by the spring 96. Only a light spring is required, so that when the spring pressure plus the force exerted by the system pressure in chamber 52 is greater than atmospheric pressure acting in the opposite direction in chamber 70 the system remains sealed to atmosphere, and vice-versa.

Other designs of non-return valve may be used to like effect.

We claim:

1. A flame failure device comprising:

a. A fuel supply line for delivering fuel to a burner to establish a flame;

b. a normally closed fuel control valve in said supply line; and c. a gas system for opening and closing said valve in response to the presence and absence, respectively, of a flame at said burner;

said gas system comprising:

d. A gas reservoir containing a gas and located in a position exposed to said flame;

e. a displaceable, imperforate membrane;

f. a capillary tube extending between said reservoir and said membrane, whereby gas in said reservoir may become heated by said flame and expand and displace said membrane;

g. means responsive to the displacement of said membrane to open said control valve and maintain said control valve open as long as said flame endures;

h. return means acting on said control valve for closing the latter in response to extinguishment of said flame;

i. gas passage means for recharging said reservoir with gas from a source other than said reservoir; and j. recharging valve means in communication with said gas passage means and operable in response to a predetermined reduction in gas pressure in said reservoir to enable gas to enter said reservoir and recharge the latter.

2. A flame failure device according to claim 1 wherein said gas is air.

3. A flame failure device according to claim 1 including means acting on said recharging valve to maintain it closed when pressure in said reservoir equals or exceeds a predetermined value.

4. A flame failure device according to claim 3 wherein the means acting on said recharging valve is magnetic.

5. A flame failure device according to claim 3 wherein the means acting on said recharging valve comprises a spring.

6. A flame failure device according to claim 1 wherein said control valve is part of a servo valve mechanism.

7. A flame failure device according to any preceding claim wherein said recharging gas passage communicates with said capillary tube between said reservoir and said membrane.

* * * * *